US006135707A

United States Patent [19]

Endries et al.

[11] Patent Number: 6,135,707

[45] Date of Patent: Oct. 24, 2000

[54] STEAM TURBINE WITH A CONDENSER AND METHOD OF COOLING A STEAM TURBINE IN THE VENTILATION MODE

[75] Inventors: Hans-Joachim Endries, Essen; Claus Eggert; Hans Stein, both of Mülheim; Rolf-Dieter Koch, Castrop-Rauxel, all of Germany

[73] Assignee: Siemens Aktiengesellschaft, Munich, Germany

[21] Appl. No.: 09/277,276

[22] Filed: Mar. 26, 1999

Related U.S. Application Data

[63] Continuation of application No. PCT/DE97/02050, Sep. 12, 1997.

[30] Foreign Application Priority Data

Sep. 26, 1996 [DE] Germany ..... 196 39 722

[51] Int. Cl.[7] ..... F01D 17/18

[52] U.S. Cl. ..... 415/1; 415/26; 415/58.5

[58] Field of Search ..... 415/1, 29, 47, 415/49, 50, 58.5, 58.7, 59.1, 169.1, 169.2, 11

[56] References Cited

U.S. PATENT DOCUMENTS

| | | | |
|---|---|---|---|
| 1,447,081 | 2/1923 | Herr . | |
| 3,173,654 | 3/1965 | Roe | 415/1 |
| 4,793,132 | 12/1988 | Okabe | 60/39.182 |
| 5,490,386 | 2/1996 | Keller et al. | 60/660 |

FOREIGN PATENT DOCUMENTS

| | | |
|---|---|---|
| 0 602 040 B1 | 3/1993 | European Pat. Off. . |
| 928 346 | 10/1954 | Germany . |
| 238206 | 10/1945 | Switzerland . |

*Primary Examiner*—Edward K. Look
*Assistant Examiner*—Ninh Nguyen
*Attorney, Agent, or Firm*—Herbert L. Lerner; Laurence A. Greenberg; Werner H. Stemer

[57] ABSTRACT

The steam turbine has an interior chamber through which an action steam can flow. The action steam is condensed in a condenser. The condenser is connected to the interior via a cooling-steam conduit. The cooling-steam conduit can be shut off by means of a shut-off member which opens as a function of the differential steam pressure between the condenser and the interior. The method of cooling the steam turbine is effected by cooling the steam turbine with steam from the condenser in the ventilation mode of the turbine.

9 Claims, 2 Drawing Sheets

STEAM TURBINE WITH A CONDENSER AND METHOD OF COOLING A STEAM TURBINE IN THE VENTILATION MODE

CROSS-REFERENCE TO RELATED APPLICATION

This application is a continuation of copending International application No. PCT/DE97/02050, filed Sep. 12, 1997, which designated the United States.

BACKGROUND OF THE INVENTION

Field of the Invention

The invention relates to a steam turbine with an interior through which an action steam can flow and with a condenser for condensing the action steam. The invention further relates to a method of cooling a steam turbine, in particular a low-pressure steam turbine, in the ventilation mode.

U.S. Pat. No. 1,447,081 describes a reaction steam turbine without a condenser. In that steam turbine, a flow connection is made via a by-pass conduit between a conduit subjected to a steam flow and a region between an idly running high-pressure and low-pressure part. A valve must be opened in order to make the connection. The turbine is, in particular, a marine turbine plant which is configured for forward (ahead) operation and reverse (astern) operation.

For forward operation, the turbine has a blade section comprising a impulse section, a high-pressure reaction section and a low-pressure reaction section. For reverse operation, the turbine has a further additional impulse section which is located axially downstream of the low-pressure reaction section and which acts on the same turbine shaft. A steam flow emerging from the low-pressure reaction section during forward operation is discharged into the same exhaust-steam connection piece as a steam flow through the impulse section for reverse operation. The low-pressure reaction section and the impulse section for reverse operation are consequently in fluidic communication with one another. In reverse operation, therefore, at least a small portion of steam passes into the low-pressure reaction-section. In order, in this case, to prevent the steam from standing, which, due to the rotation of the idly running low-pressure blades, would lead to heating of the blades, a bypass conduit leading from a chamber between the high-pressure and the low-pressure section to the exhaust-steam connection piece is provided. The valve which must be closed during the forward operation of the turbine is disposed in the bypass conduit.

It has become known, for example from the disclosure in European patent EP 0 602 040 B1, to cool a low-pressure steam turbine in the ventilation mode, the rotor of the steam turbine being rotated without being subjected to expanding steam. Such a ventilation mode occurs, for example, in a multi-cylinder turbo set, in which there is provided, upstream of a low-pressure steam turbine, a possibility of diverting action steam, otherwise to be expanded in the low-pressure steam turbine, into a heating heat exchanger or the like. Cooling in the ventilation mode is carried out, according to EP 0 602 040 B1, by feeding steam into a tapping point provided between an inlet for the action steam to be expanded and an outlet for this steam. The tapping point is connected, for example, to the steam space of a condenser, the quantity of steam supplied and/or of condensate supplied being regulated as a function of a temperature value determined in the steam turbine. As compared with injection at the outlet, during which the cooling effect is restricted to parts of the turbine in the vicinity of the outlet, the advantage of feeding steam into a tapping point is that turbine components located further upstream are also cooled. Injection at the inlet of the steam turbine may possibly lead to condensate agglomerating in the region of the inlet and putting the blading of the turbine at risk from surging. This is likewise avoided by feeding steam into a tapping point.

Cooling of the turbine in the ventilation mode is advantageous, in particular, because, in the ventilation mode, there is in the turbine a steam atmosphere, the static pressure of which corresponds to the pressure prevailing in the condenser connected to the low-pressure steam turbine. The friction of the turbine blades on this steam (ventilation) may lead to a considerable amount of heat being generated, with the result that the turbine may be heated to high temperature and, in the extreme case, thereby subjected to an inadmissible load.

SUMMARY OF THE INVENTION

It is accordingly an object of the invention to provide a steam turbine with a condenser and a method of cooling a steam turbine in venting operation, which overcomes the above-mentioned disadvantages of the heretofore-known devices and methods of this general type and which is applicable, in particular, to low pressure steam turbines.

With the foregoing and other objects in view there is provided, in accordance with the invention, a steam turbine, comprising:

- a turbine housing having an interior formed therein through which an action steam flows during an operation of the steam turbine;
- a condenser for condensing the action steam;
- a cooling-steam conduit fluidically connected between the condenser and the interior; and
- a shut-off member disposed to selectively close the cooling-steam conduit between the interior and the condenser, the shut-off member opening the cooling-steam conduit in dependence on a differential steam pressure between the condenser and the interior.

In other words, the cooling of the steam turbine is effected in that the condenser is connected to the interior via a cooling-steam conduit which can be shut off by means of a shut-off member which opens as a function of the differential steam pressure between condenser and interior. Such a shut-off member guarantees that a flow of steam is automatically introduced from the condenser into the interior of the steam turbine if the steam pressure in the interior falls below a critical value, this taking place, in particular, in the ventilation mode.

In accordance with an added feature of the invention, the shut-off member is disposed to open the cooling-steam conduit for steam flow if a steam pressure in the condenser is higher than in the interior, and to otherwise shut the cooling-steam conduit. In other words, if the steam pressure in the condenser is higher than in the interior, the shut-off member opens the cooling-steam conduit, while it keeps the cooling-steam conduit closed when the pressure is higher in the interior. Such an automatically opening shut-off member may have a prestressing element, for example a closing spring, of which the closing force plus the pressure in the interior has to be exceeded by the steam pressure in the condenser in order to open the shut-off member.

In accordance with an additional feature of the invention, the turbine has a plurality of guide-blade rows, including a last guide-blade row, disposed in the interior and spaced apart axially in a direction of flow of the action steam, and wherein the cooling-steam conduit opens into the interior at a location upstream of the last guide-blade row in the direction of flow. This location is in front of an outlet for the action steam. As a result, when a flow of the steam remaining in the condenser and the steam turbine is formed in the ventilation mode, the freely rotating moving blades of the steam turbine ensure that at least the last guide-blade row, which is heated to the greatest extent, is cooled.

In accordance with another feature of the invention, the cooling-steam conduit opens into the interior at a location upstream of the penultimate guide-blade row. In a preferred embodiment, the cooling-steam conduit opens into the interior at a location upstream of the ante-penultimate guide-blade row. This feature brings about effective cooling of the guide-blade rows that are arranged farther upstream. In the case of a double-flow low-pressure steam turbine, a corresponding cooling-steam conduit is provided for each flow. The cooling-steam conduit may, of course, also open into an existing tapping point.

In accordance with a further feature of the invention, the shut-off member is adjusted to open at a differential steam pressure of between 0.02 bar to 0.06 bar, and preferably at a steam pressure differential of 0.03 bar. Depending on the position of the opening of the cooling-steam conduit into the interior of the steam turbine, the shut-off member can preferably be set in such a way that it opens the cooling-steam conduit at another predetermined differential steam pressure. According to the invention, the object directed at a method for cooling a steam turbine in the ventilation mode is achieved in that, when a predeterminable pressure difference is present between steam in the interior of the steam turbine and in the condenser, ac cooling-steam conduit connecting the interior to the condenser is opened by means of a self-opening shut-off member and a circulation flow is thereby formed between interior and condenser.

With the above and other objects in view there is also provided, in accordance with the invention, a method of cooling a steam turbine, in particular a low-pressure steam turbine, of the type having an interior through which an action steam can flow and a condenser for condensing the action steam, the method which comprises:

providing a cooling-steam conduit between the condenser and the interior with a shut-off member; and opening the cooling-steam conduit with the shut-off member in dependence on a differential steam pressure between the condenser and the interior for allowing a steam flow into the interior which opens, and cooling the steam turbine with steam from the condenser in the ventilation mode of the steam turbine.

Other features which are considered as characteristic for the invention are set forth in the appended claims.

Although the invention is illustrated and described herein as embodied in steam turbine with condenser and method for cooling a steam turbine in the ventilation mode, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings. The steam turbine and the method of cooling the steam turbine in the ventilation mode are explained in more detail with reference to the exemplary embodiment illustrated in the drawing which, in partially schematic illustration, is not necessarily true to scale.

DESCRIPTION OF THE PREFERRED EMBODIMENTS

Figure 1:
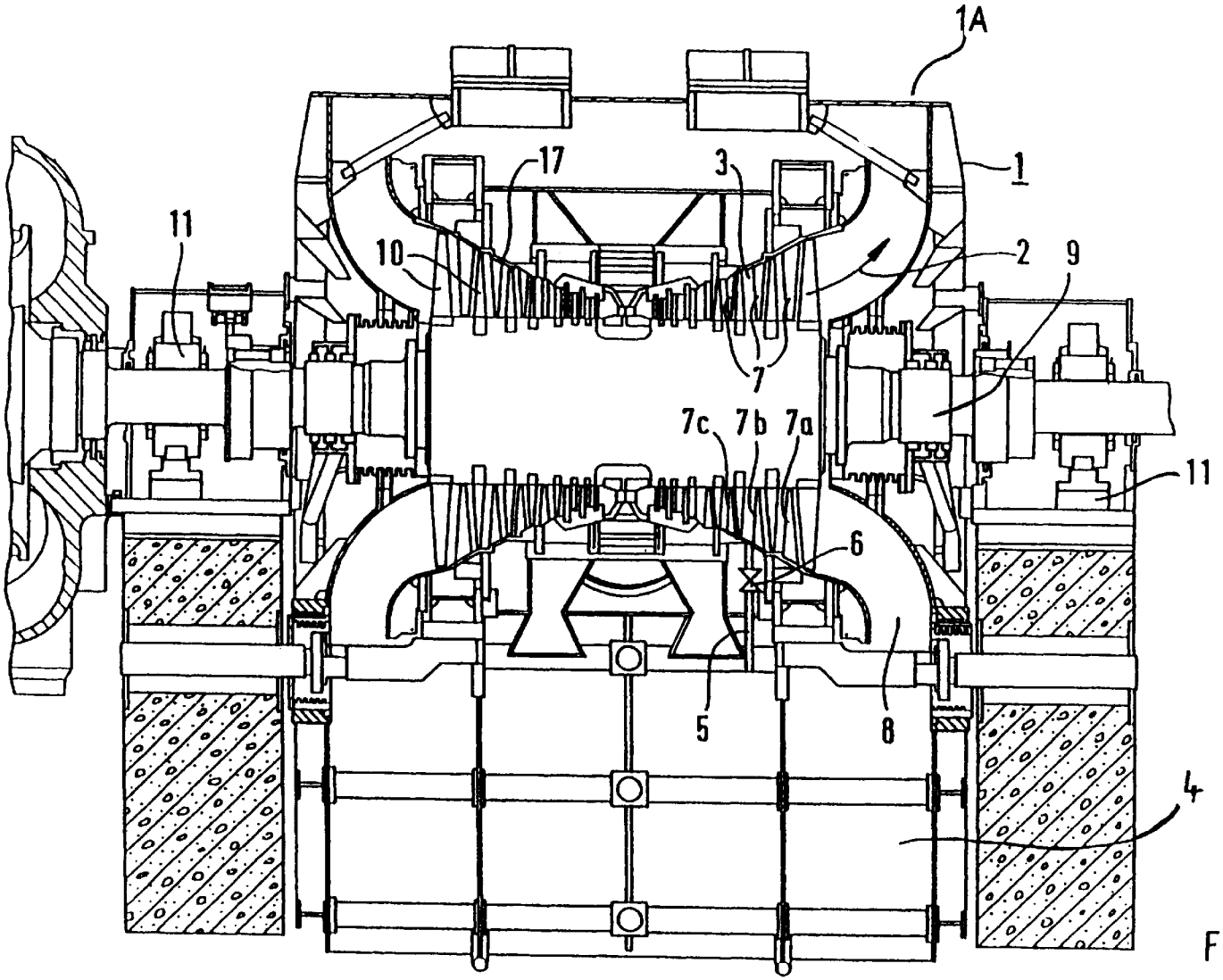
FIG. 1 is a longitudinal section taken through a low-pressure steam turbine of a turbine plant.

Referring now to the figures of the drawing in detail and first, particularly, to FIG. 1 thereof, there is seen a longitudinal section through a double-flow low-pressure steam turbine 1 which is part of a steam turbine plant. The complete turbine plant is not illustrated, as an illustration thereof is not necessary for an understanding of the invention. The steam turbine 1 has a housing 1A and a turbine shaft 9 which is mounted on two shaft bearings 11 arranged on both sides of the steam turbine 1. The steam turbine 1 has an interior 3, in which there are disposed the guide blades 7 connected to a turbine inner housing 17 and the moving blades 10 connected to the turbine shaft 9. In a normal power mode of the steam turbine 1, an action steam 2 driving the moving blades 10 and at the same time expanding flows in the axial direction through the interior 3 and flows out of the interior 3 through an exhaust-steam connection piece 8. The exhaust-steam connection piece 8 opens into a condenser 4 which essentially surrounds the interior 3.

In the normal power mode of the steam turbine 1, the expanded action steam 2 is cooled in the condenser 4 and is precipitated there as condensate. The condenser 4 is connected to the interior 3 via a cooling-steam conduit 5, in which an automatically opening shut-off member 6 is arranged. The cooling-steam conduit 5 opens out upstream of the last guide-blade row 7*a*, as seen in the direction of flow of the action steam 2. It preferably opens out between the penultimate guide-blade row 7*b* and the antepenultimate guide-blade row 7*c*. The cooling-steam conduit 5 is designed, for example, as a pipeline having a circular cross-section and a diameter of about 0.6 m. The shut-off member 6 is designed in such a way that the cooling-steam conduit 5 is kept shut off when the steam turbine 1 is in a normal power mode. If the inflow of action steam 2 is prevented, while the turbine shaft 9 can continue to rotate (i.e., the so-called ventilation mode), the shut-off member 6 releases the cooling-steam conduit 5 as soon as the steam pressure in the condenser 4 is higher than in the interior 3. The pressure difference between the interior 3 and the condenser 4 which is necessary for opening the shut-off member 6 is preferably about 0.3 bar, or less. After the shut-off member 6 has opened, steam flows out of the condenser 4 into the interior 3 and leads to cooling of the last turbine guide-blade rows 7*a*, 7*b*, 7*c* which are heated as a result of friction on the steam which has remained in the interior 3. A circulation flow of steam from the condenser 4 into the interior 3 and back into the condenser 4 is formed.

Figure 2:
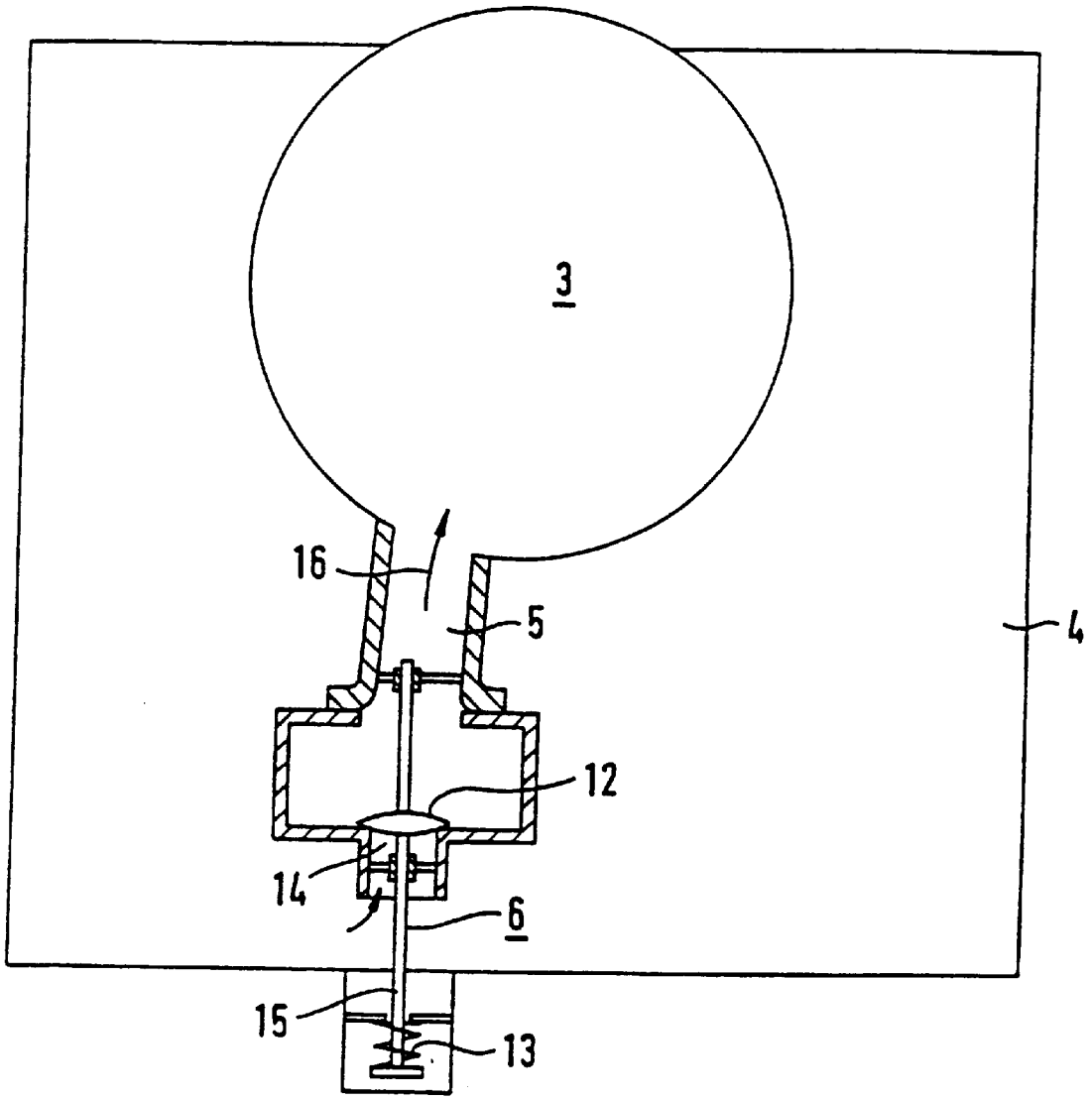
FIG. 2 is a partly diagrammatic cross-section taken through the low-pressure steam turbine.

Referring now to FIG. 2, there is shown a cross-section through a low-pressure steam turbine 1 with a cooling-steam conduit 5 connecting the condenser 4 and the interior 3. The cooling-steam conduit 5 is connected to a shut-off member 6 formed with a valve orifice 14 which is closed by a sealing element 12 when the steam turbine 1 is in a power mode. This prevents a direct inflow of action steam 2 into the condenser 4 via the cooling-steam conduit 5 in the power mode, in which the steam pressure in the interior 3 is substantially higher than in the condenser 4. In this case not only does the pressure difference between the steam pressure in the interior 3 and that in the condenser 4 cause the sealing element 12 to be pressed onto the valve orifice 14, but a closing spring 13 of adjustable spring force, which causes the shut-off member 6 to be closed, is also provided. In this case sealing element 12 and closing spring 13 are connected via a piston rod 15 guided via bearings. The closing force of the spring 13 ensures that the sealing element 12 releases the valve orifice 14 only once the force acting on the sealing element 12 by means of the pressure in the condenser 4 exceeds the force generated by the pressure prevailing in the interior 3 plus the closing force of the closing spring 13. Due to the adjustability of the closing spring 13, the opening of the shut-off member 6 may be appropriately adapted according to the conditions required for the ventilation mode. It goes without saying that other self-opening shut-off members, in particular valves, which open as a result of a prevailing pressure difference, may also be used.

The invention is distinguished in that a connecting conduit between a condenser of a steam turbine and the interior of the steam turbine is opened by means of an automatically opening valve as soon as a predetermined pressure difference is present between the steam atmosphere in the interior and the steam in the condenser. This ensures that the cooling of the steam turbine commences automatically on occasion of a change-over from the power mode to the ventilation mode of the steam turbine.

We claim:

1. A steam turbine, comprising:

a turbine housing having an interior formed therein through which an action steam flows during an operation of the steam turbine;

a condenser for condensing the action steam;

a cooling-steam conduit fluidically connected between said condenser and said interior; and a shut-off member disposed to selectively close said cooling-steam conduit between said interior and said condenser, said shut-off member opening the cooling-steam conduit in dependence on a differential steam pressure between said condenser and said interior.

2. The steam turbine according to claim 1, wherein said shut-off member is disposed to open said cooling-steam conduit for steam flow if a steam pressure in said condenser is higher than in said interior, and to otherwise shut said cooling-steam conduit.

3. The steam turbine according to claim 1, which further comprises a plurality of guide-blade rows, including a last guide-blade row, disposed in said interior and spaced apart axially in a direction of flow of the action steam, and wherein said cooling-steam conduit opens into said interior at a location upstream of said last guide-blade row in the direction of flow.

4. The steam turbine according to claim 3, wherein said plurality of guide-blade rows further includes a penultimate guide-blade row, and said cooling-steam conduit opens into said interior at a location upstream of said penultimate guide-blade row.

5. The steam turbine according to claim 3, wherein said plurality of guide-blade rows further includes a penultimate guide-blade row and an ante-penultimate guide-blade row, and said cooling-steam conduit opens into said interior at a location upstream of said ante-penultimate guide-blade row.

6. The steam turbine according to claim 1, wherein said shut-off member is adjusted to open at a differential steam pressure of between 0.02 bar to 0.06 bar.

7. The steam turbine according to claim 1, wherein said shut-off member is adjusted to open at a differential steam pressure of substantially 0.03 bar.

8. A method of cooling a steam turbine of the type having an interior through which an action steam can flow and a condenser for condensing the action steam, the method which comprises:

providing a cooling-steam conduit between the condenser and the interior with a shut-off member; and opening the cooling-steam conduit with the shut-off member in dependence on a differential steam pressure between the condenser and the interior for allowing a steam flow into the interior which opens, and cooling the steam turbine with steam from the condenser.

9. The method according to claim 8, wherein the providing step comprises providing the cooling-steam conduit in a low-pressure steam turbine and the steam turbine is cooled in a ventilation mode thereof.

* * * * *